United States Patent [19]

Fredriksson et al.

[11] Patent Number: 4,493,363

[45] Date of Patent: Jan. 15, 1985

[54] METHOD AT CONTINUOUS CASTING OF STEELS AND METAL ALLOYS WITH SEGREGATION TENDENCY AND APPARATUS FOR CARRYING OUT THE METHOD

[75] Inventors: Hasse Fredriksson, Stockholm; Lars Tiberg, Fagersta, both of Sweden

[73] Assignee: Jernkontoret, Stockholm, Sweden

[21] Appl. No.: 819,214

[22] Filed: Jul. 26, 1977

[30] Foreign Application Priority Data

Jul. 30, 1976 [SE] Sweden ..... 7608617

[51] Int. Cl.[3] ..... B22D 11/12; B22D 11/124

[52] U.S. Cl. ..... 164/476; 164/486

[58] Field of Search ..... 164/76, 82, 441, 442, 164/447, 448, 270, 89, 444

[56] References Cited

U.S. PATENT DOCUMENTS

| | | | |
|---|---|---|---|
| 3,478,809 | 11/1969 | Tarmann et al. | 164/82 |
| 3,747,664 | 7/1973 | Schoffmann | 164/76 |
| 3,766,963 | 10/1973 | Rossi | 164/442 X |
| 3,773,099 | 11/1973 | Rossi | 164/442 X |
| 3,842,895 | 10/1974 | Mehrabian et al. | 164/82 X |
| 3,938,584 | 2/1976 | Meylan | 164/442 |
| 3,946,797 | 3/1976 | Thalmann | 164/442 |
| 3,974,559 | 8/1976 | Kawawa et al. | 164/76 X |
| 4,000,771 | 1/1977 | Williamson | 164/89 X |
| 4,010,792 | 3/1977 | Ishiguro et al. | 164/76 |

*Primary Examiner*—Nicholas P. Godici
*Assistant Examiner*—J. Reed Batten, Jr.
*Attorney, Agent, or Firm*—LeBlanc, Nolan, Shur & Nies

[57] ABSTRACT

A method for preventing segregations in continuous casting by deforming the continuous strand plastically during the solidification in such a way that the cross sectional area of the strand is physically reduced corresponding substantially to the solidification shrinkage of the metal. The method avoids upward or downward transport of melt in the solidifying strand. The reduction in most cases will be 2-6% and can be accomplished with apparatus having a number of pair of strand reducing rolls or jets along the strand, to reduce it a number of times, each time less than the total desired reduction. The reduction of the strand from casting to the final strand follows the solidification shrinkage.

2 Claims, 10 Drawing Figures

Figure 1:
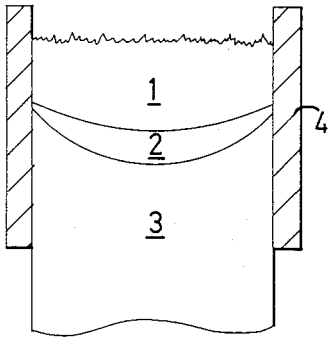

Fig. 7
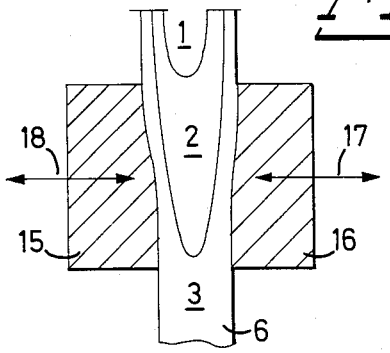
Fig. 8
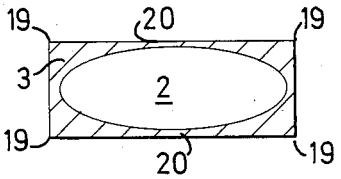
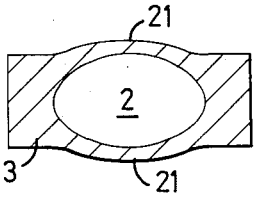
Fig. 9
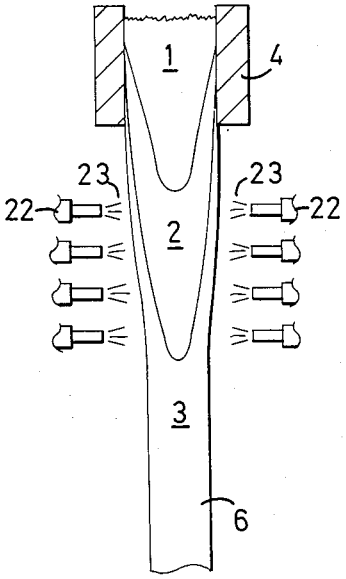
Fig. 10

METHOD AT CONTINUOUS CASTING OF STEELS AND METAL ALLOYS WITH SEGREGATION TENDENCY AND APPARATUS FOR CARRYING OUT THE METHOD

This invention relates to a method and an apparatus for preventing the formation of carbide segregations in continuous casting.

In the continuous casting of high-carbon steels, for example ball bearing steels, high-speed tool steels and also other steels with high carbon content, distinctive carbide segregations appear which render the material unsuitable for many fields of application. The same kind of carbide segregations also can arise when the aforesaid steels are cast in conventional chills and at ESR-remelting at high melting rates.

Carbide segregations are formed during the solidification of the inner parts of an ingot. Due to the large solidification intervals of the steels, relatively thick zones of semi-solidified material are there formed. In said zones dendrites form a porous network of solidified material with a lower than average carbon content and a lower than average content of impurities in the material. In the intermediate spaces between the dendrites, thus, residual melts with higher carbon content are located. During the solidification the material shrinks, partly as solidification shrinkage of about 4% and partly as cooling shrinkage in material already solidified.

The material solidifies from the outer surfaces inward to the centre of the material. This results in several solidification fronts existing during the solidification and growing toward the material centre. In continuous casting, furthermore, a strand with unsolidified material in the centre moves from a chill downward. Depending on the dimension of the strand and its casting rate, the solidification zone, i.e. the zone with semi-solidified material, varies in the longitudinal direction of the strand with respect to length and other dimensions. When the solidification zone has an unfavourable configuration, i.e. when it is long and thick, high stresses arise between solidification fronts having met. These stresses arise, because the outer surfaces of the strand are solidified and only shrink because of cooling shrinkage, while the interior of the strand shrinks because of the greater solidification shrinkage. As a result of these stresses, the fronts separate. The shrinkage gives rise to a vacuum, which sucks down the melt through the porous semi-solidified material. This melt is enriched with impurities and alloying elements and, consequently, large carbide segregations are formed in the centre of the strand. Corresponding conditions prevail at all alloys with great solidification intervals and give rise to segregations.

When the solidification zone is long, and the material solidifies and shrinks in central portions of the strand, relatively large amounts of melt must be transported to the semi-solidified zone. As a result thereof, substantial macro-segregations arise which form pores and cracks in the central portion. In continuous casting it is known that carbide segregations can be reduced by carrying out the casting very slowly. The casting rate, however, in that case must be reduced so much that the process is uneconomic.

The present invention relates to a method of preventing the aforesaid formation of carbide segregations in continuous casting. The invention is characterized in that the cast strand during solidification is subjected to plastic deformation, so that the cross-section area of the strand is reduced to a degree corresponding to or slightly exceeding the solidification shrinkage of the material.

Figure 2:
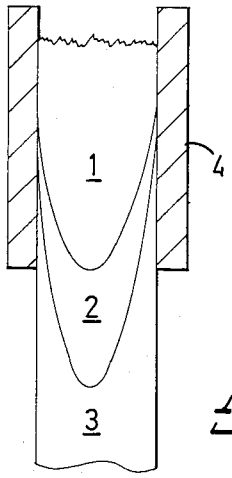

The invention is described in greater detail in the following, with reference to the accompanying drawings, in which FIGS. 1 and 2 each are a longitudinal section through a strand and associated chill.

Figure 3:
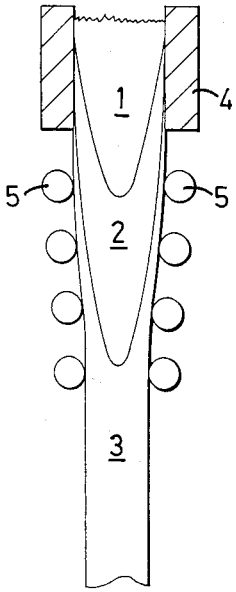

FIG. 3 is a longitudinal section through a strand and associated chill and a device for effecting plastic deformation of the strand.

Figure 4:
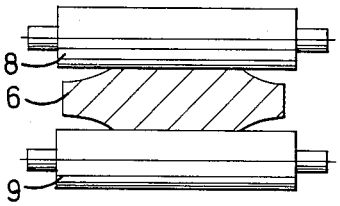
Figure 5:
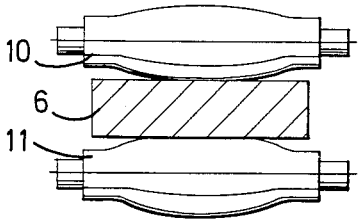
Figure 6:
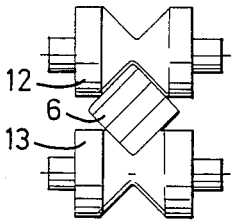

FIGS. 4–6 each are a cross-section of a strand during its plastic working.

FIG. 7 is a longitudinal section of such a strand.

FIGS. 8–9 each are a cross-section of a strand in different solidification phases.

FIG. 10 is a longitudinal section of a strand.

The formation of suctions, stresses and cracks in a semi-solidified area depends on the configuration of the solidification zone. FIG. 1 shows a solidification zone having a favourable configuration with respect to suctions, stresses and cracks, because the semi-solidified material 2 has a short extension in the vertical direction in FIG. 1, i.e. in the longitudinal direction of the strand. The semi-solidified material 2 is surrounded by molten material 1 and solidified material 3. A chill 4 encloses the strand 1, 2, 3. A solidification zone of the configuration shown in FIG. 1 arises at a very low-rate continuous casting, at normal ESR-recasting and at the casting of a thick, short ingot. FIG. 2 shows a solidification zone having an unfavourable configuration, because the semi-solidified material 2 has a large vertical extension. This type of solidification zone is formed in normal and rapid continuous casting, at high-rate ESR-remelting and at the casting of a long, narrow ingot. When a material, which is cast by normal or rapid continuous casting, see FIG. 2, shrinks at the centre, relatively large amounts of melt 1 are transported downward from above, in FIG. 2, due to the relatively large area with semi-solidified material. As a result thereof, substantial segregations arise, as mentioned above, over a larger area, in the form of so-called macro-segregations, which give rise to pores and cracks in the central portion. The process described with reference to FIG. 2 is the normal process in continuous casting. The casting rate is so high, that the solidification zone is relatively long. The above known technique for preventing carbide segregations consists of low-rate casting whereby a small solidification zone, according to FIG. 1, is formed. This process, however, is unfavourable from an economic aspect.

According to the present invention, the strand is deformed plastically so that the area reduction substantially corresponds to or slightly exceeds the solidification shrinkage in the material. Preferably, the plastic deformation of the strand is effected substantially in the place where the strand consists of both semi-solidified and solidified material. When the central portions solidify and this material shrinks by solidification, the strand is subjected to a reducing working so that its cross-section area is reduced to a dimension corresponding to the area of a solidified and entirely welded-together material over the cross-section of the strand. Due to this process, melt cannot be sucked down into the semi-solidified material 2. Consequently, the formation of macro-segregations as well as of pores and cracks in the central portions is prevented.

In FIG. 3 a device is shown, by which a working operation for deforming the strand can be carried out. The molten metal is poured down through the chill 4 and solidifies substantially immediately on the surface. The solidified strand is passed down and out of the chill 4, and thereafter is introduced between a plurality of roll pairs 5. Each of said roll pairs 5 has a spaced relationship between the rolls which brings about an area reduction corresponding to the solidification shrinkage occurring in the strand at each roll pair. The strand, thus, from the first roll pair and downward is entirely welded-together at its centre. After the last roll pair, the strand is entirely solidified. Due to this successive working, the molten material 1 (so-called "melt") will not be sucked down into the semi-solidified material 2 when the solidification shrinkage commences.

In the continuous casting of workpieces with rectangular cross-section, so-called slabs, the corners and portions adjacent thereto are cooled much more rapidly than the remaining part of the strand. As a result thereof, the solidification shrinkage, which causes the sucking down of melt 1 into the semi-solidified material 2, takes place in the central strand portions, which solidify at a later time. This implies that only the broad sides of a strand with rectangular cross-section shall be worked. This is accentuated thereby that a strand, due to the stronger cooling at the corners, tends to assume a greater thickness at the centre of the broad sides where the material is hotter.

FIG. 4 shows in a schematic way a device according to an embodiment of the invention, at which only a portion of the broad sides of a strand is intended to be worked. A strand 6 with convex broad sides is cast in a chill 4 (see FIG. 3) and worked between two plane rolls 8, 9. Thereby only that portion of the convex broad sides is worked which has contact with the plane rolls. After the working, the strand has a reduced cross-section area, because the strand has assumed a less convex configuration while the areas at the corners of the strand are substantially unworked. The convexity of the strand can be adjusted at casting so that, as a result of the necessary reduction of the cross-section by working with rolls, the strand after the working has a rectangular cross-section.

The reduction of the strand according to the embodiments described above and in the following must be so great, that it slightly exceeds the reduction in area which corresponds to the solidification shrinkage going on. The reduction must be carried out in several steps, as indicated in FIG. 3, so that a substantially continuous area reduction is obtained which is adjusted to and corresponds to the solidification shrinkage. Tensile stresses in the solidifying material are hereby avoided and only moderate compressive stresses are obtained. The number of reduction steps is determined by practical factors, especially by the casting rate and, thereby, the length of the solidification zone. In high-speed continuous casting machines, with a solidification zone length of up to 20 meters, the working can take place in 20 to 40 steps, while in slower operating machines, for example an ESR-machine, the working must be carried out in a few steps.

A suitable total reduction of the cross-sectional area of the strand generally is 1–10%, preferably 2–6%. For steel, a suitable reduction generally is 4%.

The rolls 8, 9 are arranged to rotate at the same circumferential speed as the rate of the cast strand at said roll pair. A plurality of roll pairs similar to the roll pair 8,9 can be positioned with different spaced relationship to the chill, as shown in FIG. 3.

Another embodiment is shown in FIG. 5, according to which the strand 6 is cast with rectangular cross-section and plane broad sides, and the working is carried out with rolls 10, 11, which are cambered, i.e. so designed as to have a diameter decreasing from the centre to both ends.

According to this embodiment, a strand is obtained after the working which has the smallest thickness at its centre and increasing thickness to the short sides of the substantially rectangular cross-section of the strand. In general, the above information with respect to the plane rolls 8, 9 according to FIG. 4 and the roll pairs in FIG. 5 applies also to this embodiment. A corresponding working of strands with square cross-section, octagonal cross-section, round cross-section or a cross-section of another shape can be carried out by means of tools, which enclose the strand as completely as possible, because the cooling of the strand at such cross-sections is more symmetric than at strands with rectangular cross-section.

In order to illustrate this, FIG. 6 shows schematically a device for working a strand with substantially square cross-section. The strand 6 is worked by means of two rolls 12, 13, which are provided with grooves, the configuration of which corresponds to the shape of the strand at two diagonally opposite corners. The grooves 14 are given such a depth, that they together substantially enclose the strand, which is being worked, also along its sides. When several roll pairs similar to the rolls 12, 13 are arranged one after the other, the axles of such roll pairs can form an angle of 90° with each other in order to work the strand symmetrically. A further embodiment of the invention is shown schematically in FIG. 7. A strand 6 is worked here by means of two opposed reciprocating forging tools 15, 16 with working surfaces facing toward each other, which surfaces between themselves form a space adjusted to the shape of the strand and to the type of working, to which the strand is to be subjected. Said space tapers to wedge shape in the direction of strand movement in order to subject the strand to the desired reduction with respect to its cross-section area. The arrows 17, 18 in FIG. 7 indicate the direction of movement of the tools 15, 16. In this device, the strand 6 is advanced one step when the forging tools 15, 16 move away from each other, and is deformed when said tools move toward each other. By working the strand by means of forging tools 15, 16 conical in the longitudinal direction of the strand 6, an almost continuous reduction of the cross-section of the strand is obtained.

The working surfaces of the forging tools 15, 16 can perpendicularly to the longitudinal direction of the strand 6 be formed plane, convex or concave, depending on the cross-sectional shape of the strand 6.

According to a further embodiment of the invention, the reduction of the cross-section of the strand 6 is effected by controlled cooling of the strand 6.

Immediately after its leaving the chill 4, (FIG. 10), the strand 6 has a cross-section corresponding to the inner form of the chill 4. In FIG. 8 a rectangular cross-section of a strand is shown as an example. The corners 19 and the areas immediately adjacent thereto are colder than the centre on the broad sides 20 of the strand 6 and the material inside thereof. The solidification process is shown by way of example in FIG. 8, with solidified material 3 at the colder portions and semi-solidified material 2 in the interior of the strand. Due to this temperature difference, the strand is thinner adjacent the corners 19 than at its centre, because solidification shrinkage and cooling shrinkage have occurred adjacent the corners 19, whereby the strand assumes a convex appearance as shown in FIG. 9. According to this embodiment, a reduction of the cross-section area of the strand 6 is obtained thereby, that the broad sides of the strand 6 are subjected to forced cooling, whereby the surface layer of the convex portions and solidified material 21 inside thereof are contracted and deform the centrally located semi-solidified material. Thereby the necessary deformation of the strand is obtained. The cooling, thus, is started during the final solidification phase of the strand, as appears from above.

This embodiment can be applied also to strands with other cross-sections. In the case of square, octagonal, round or like shape of the strand, the forced cooling is carried out so that all sides or outer surfaces of the strand are cooled. This implies, that the entire outer shell of the strand shrinks as a result of the cooling shrinkage, whereby the necessary reduction of the cross-section takes place and the inner semi-solidified strand material is deformed.

The forced cooling is effected by a plurality of nozzles 22 (FIG. 10), which eject coolant 23 against the strand 6 in the above indicated places. The coolant may be water, water-air mixture or steam.

The invention is not to be regarded restricted to the embodiments described and shown, but can be varied within the scope defined by the attached claims. The mechanic plastic working, for example, can be varied in different ways, and also the cooling device, if cooling is used for bringing about the cross-section reduction, can be modified in a suitable way within the scope of the invention.

What we claim is:

1. A method of preventing the formation of segregations in continuous casting of steel and metal alloys in a strand cast from molten metal, where the cast strand is formed from a molten metal introduced, through a casting chill and undergoing solidification to a rectangular cross-section solid strand, characterized by physically deforming the cast strand by action on its external surface, in successive steps from just below the chill to a point where the strand is fully solidified, controlling said deforming so that the cross-section area of the strand is reduced to an extent in each of said steps corresponding to the solidification shrinkage and cooling shrinkage of the strand at the position of said step, said physically deforming obtained by the action of subjecting the broad sides of said cast rectangular strand at the central portions thereof to forced cooling after it has left the chill used for casting, said deforming steps substantially avoiding upward and downward transport of melt in the strand from the chill to the point where the strand is fully solidified.

2. A method of preventing the formation of segregations in continuous casting of steel and metal alloys in a strand cast from molten metal, where the cast strand is formed from a molten metal introduced through a chill and undergoing solidification to a solid strand of square, octagonal, round or like cross-section, characterized by physically deforming cast strand by action on its external surface, in successive steps from just below the chill to a point where the strand is fully solidified, controlling said deforming so that the cross-section area of the strand is reduced to an extent in each of said steps corresponding to the solidification shrinkage and cooling shrinkage of the strand at the position of said step, said physically deforming obtained by the action of subjecting all sides or outer surfaces of the strand to forced cooling after it has left the chill used for the casting, said deforming steps thereby substantially avoiding upward and downward transport of melt in the strand from the chill to the point where the strand is fully solidified.

* * * * *

UNITED STATES PATENT AND TRADEMARK OFFICE

CERTIFICATE OF CORRECTION

PATENT NO. : 4,493,363

DATED : January 15, 1985

INVENTOR(S) : Fredriksson et al.

It is certified that error appears in the above-identified patent and that said Letters Patent is hereby corrected as shown below:

On the title page:

Change title from "METHOD AT CONTINUOUS CASTING OF STEELS AND METAL ALLOYS WITH SEGREGATION TENDENCY AND APPARATUS FOR CARRYING OUT THE METHOD" to -- METHOD OF PREVENTING FORMATION OF SEGREGATIONS DURING CONTINUOUS CASTING--

Signed and Sealed this

*Twenty-first* Day of *May 1985*

[SEAL]

*Attest:*

DONALD J. QUIGG

*Attesting Officer* *Acting Commissioner of Patents and Trademarks*